US006772916B1

(12) United States Patent
Reynolds

(10) Patent No.: US 6,772,916 B1
(45) Date of Patent: Aug. 10, 2004

(54) HIDDEN LOCKING SYSTEM FOR WALL-MOUNTED DISPENSER

(75) Inventor: Aaron R. Reynolds, North Canton, OH (US)

(73) Assignee: Joseph S. Kanfer, Richfield, OH (US)

( * ) Notice: Subject to any disclaimer, the term of this patent is extended or adjusted under 35 U.S.C. 154(b) by 175 days.

(21) Appl. No.: 10/190,009

(22) Filed: Jul. 8, 2002

(51) Int. Cl.[7] ..... B67D 5/06

(52) U.S. Cl. ..... 222/181.3; 222/153.01; 222/153.03; 222/153.04; 222/165; 222/180; 221/154

(58) Field of Search ..... 222/153.01, 153.03, 222/153.04, 153.09, 160, 164, 165, 173, 180, 181.3; 221/154; 137/383

(56) References Cited

U.S. PATENT DOCUMENTS 5,183,182 A * 2/1993 Comstock et al. ..... 222/129
5,413,251 A * 5/1995 Adamson ..... 222/129
5,632,418 A * 5/1997 Brown ..... 222/180
5,695,065 A * 12/1997 Kennedy et al. ..... 206/554

* cited by examiner

*Primary Examiner*—Timothy L. Maust
(74) *Attorney, Agent, or Firm*—Renner, Kenner, Greive, Bobak, Taylor & Weber

(57) ABSTRACT

A locking system for a dispenser having a cover and a back plate, the cover being hingedly connected at one end to the back plate and carrying a latch plate at the opposed end thereof. An elongate locking bar is slidably carried on the back plate for movement toward and away from engagement with the latch plate. This movement is achieved by provision of an engagement member of the back plate slidably movable into contact with the locking bar and a key similarly movable into the contact with the engagement member. To that end, the engagement member includes opposed resilient legs, the distal ends of which normally rest on the bottom of the interior of the cover.

The key is provided with a divider which, when engaged with the resilient legs spreading them apart and enables shoulders on the key to contact the engagement member and move the locking bar upwardly to disengage the latch.

11 Claims, 7 Drawing Sheets

HIDDEN LOCKING SYSTEM FOR WALL-MOUNTED DISPENSER

RELATED PATENT APPLICATIONS

None.

BACKGROUND OF THE INVENTION

This invention relates in general to wall-mounted dispensers for soaps, lotions and other liquid of fluid materials and relates in particular to a wall-mounted dispenser having a back plate for mounting on the wall and a cover hingedly connected to the back plate and more particularly yet to locking means for locking the cover in the closed position with respect to the back plate.

DESCRIPTION OF THE PRIOR ART

It is well known that various types of dispensers can be utilized to dispense soaps, lotions or other liquids through various pump means. These dispensers take many forms such as freestanding, counter-mounted and wall-mounted.

The wall-mounted dispensers generally provide a compartment for receipt of a cartridge, bag or other item containing the material. These cartridges, bags, etc. are replaceable for purposes of refilling the dispenser. The pump means are attached to these replacement components and are actuated in various ways. In some instances, for example, they have been activated with a push bar hinged to the cover which engages a collapsible tube or pump extending from the replacement container. In that fashion, upon engagement and movement of the push bar against the tube or pump from the exterior of the dispenser, the pump is activated and a measured amount of the product is dispensed through the tube or pump. A wide variety of pumps and actuating means are known in the art and the present invention is not limited to use with any particularly style being more particularly directed to the means for locking the dispenser cover.

In that regard, these wall mounted dispensers commonly have a cover hingedly attached to the back plate which swings away from the mounting back plate to facilitate access to the interior for insertion and removal of the refills.

Typically, the cover is locked in place in the closed position, generally by a plate which is slidably engaged with the back plate and which has an engagement member at its top end for engagement with either the top end or the cover or a projection from the cover. The bottom end of the slidable plate is generally accessible from the bottom of the closed dispenser and can be activated by engaging the bottom edge of the plate and moving it upward to disengage the top projection from the cover thereby enabling the cover to be opened. Examples of this type of prior art can be seen in Kanfer U.S. Pat. No. 4,621,749; Bell U.S. Pat. No. 5,443,236; and Bell U.S. Pat. No. 5,465,877.

There are numerous other types of pumps and locking means known in the prior art and also numerous ways to activate the tube, pump or other projection from the dispenser either from the front or bottom of the closed dispenser. Similarly there are other types of means for engaging and disengaging the locking means.

A problem does exist, however, with the prior art in that anyone can easily engage the bottom of the sliding plate and open the dispenser either to vandalize the dispenser or to steal the replacement cartridge or to replace the cartridge with one containing material different from that which is indicated on the face of the dispenser cover. Similarly, other known locking devices are readily accessible from the exterior of the dispenser. Inasmuch as these dispensers are often located in areas such as public restrooms and other readily accessible to unobserved persons, it is believed desirable to provide a more secure locking arrangement.

Accordingly, the present invention is intended to overcome that difficulty by providing a locking system which is essentially inaccessible from the exterior of the dispenser and, indeed, invisible when the dispenser is closed and locked.

SUMMARY OF THE INVENTION

In accordance with the above, it has been found that an improved locking system, which is essentially inaccessible from the exterior of the dispenser, can be facilitated by the provision of a latch plate carried by the hinged cover of the dispenser and an elongate locking bar carried by the back plate of the dispenser intended to engage and disengage the latch to unlock and lock the cover in the closed position on the dispenser.

In furtherance of the invention, it is found that such a locking system can be developed by providing an engagement means slidably carried by the back plate of the dispenser and movable into and out of engagement with the locking bar so as to be capable of sliding it into and out of engagement with the latch plate of the cover upon actuation.

In further accordance with the principles of the invention, a key configured for slidable engagement with the engagement means can be provided wherein, upon engagement of the key with the engagement member and, thus, with the locking bar, the locking bar can be moved into and out of locking contact with the locking bar.

In furtherance of the principal object of the invention to provide a hidden locking means, it has been found that the engagement means can be provided with depending, opposed resilient legs which are flared at their ends so as to rest on the bottom of the cover out of sight when not actuated. It has been found then that the cover can be provided with apertures through which the key may be inserted so as to move the depending legs of the engagement means apart and engage the engagement means and, thus, the locking bar.

It accordingly then becomes the principal object of this invention to produce a hidden locking system for wall-mounted dispensers of the character above-described with other objects thereof becoming more apparent upon a reading of the following brief specification considered and interpreted in view of the accompanying drawings.

BRIEF DESCRIPTION OF THE PREFERRED EMBODIMENT

It will be first understood that, as described in the introductory part of this application, there are many forms of wall-mounted dispensers as well as many forms of dispensing means or pumps, known in the prior art. They all, however, have in common a back plate and a cover hingedly to the back plate for movement between an open and closed position. They also all have some means for locking the cover to the back plate in the closed position and unlocking it for opening and refill purposes. This application will be illustrated and described in relation to one particular type of dispenser with it being understood that the feature exemplified by the locking system could be utilized regardless of the other features of dispenser utilized.

Figure 1:
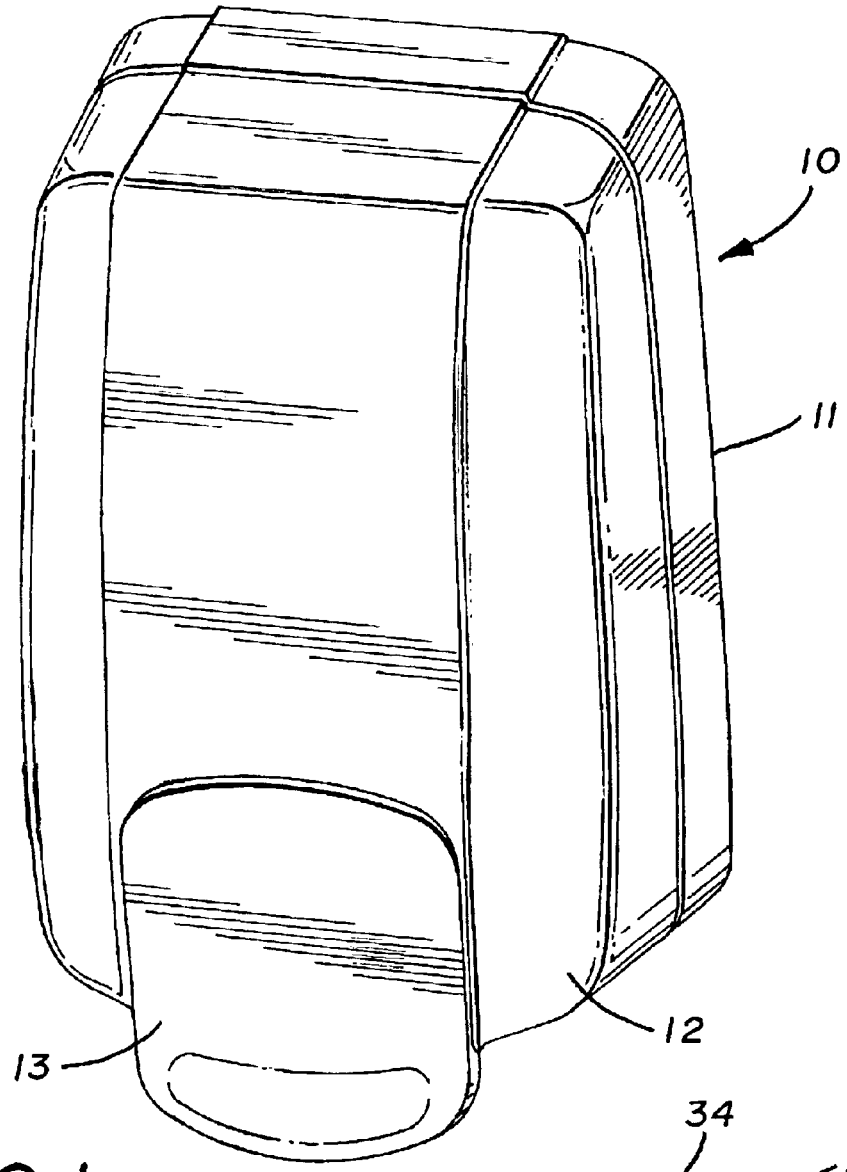
FIG. 1 is a perspective view of the dispenser in the closed position.

With that in mind and referring to FIG. 1, it will be seen that the dispenser, generally indicated by the numeral 10, includes a back plate 11, a cover 12 and a pressure bar 13.

Figure 4:
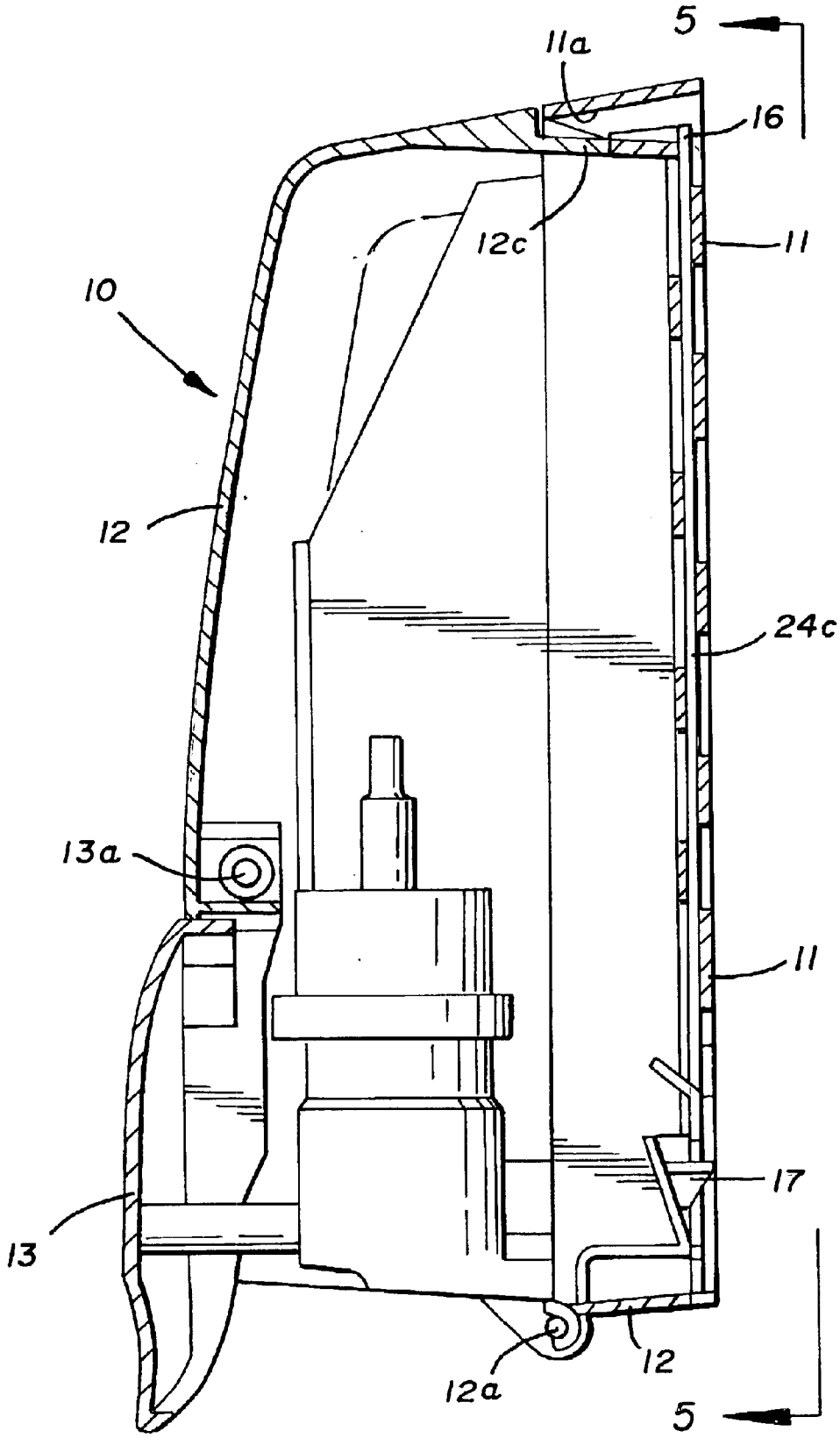
FIG. 4 is a sectional view taken along the line 4—4 of FIG. 3.

Referring to FIG. 4 of the drawings, it will be seen that a pressure bar 13 is hinged as at 13*a* to the cover so that it may be moved from left to right in FIG. 4 to engage the pump. As previously noted, there are many ways known in the art to activate any particular pumping means utilized and the arrangement illustrated is but one example.

Still referring to FIG. 4, it will also be noted that the cover 12 is hinged to the back plate 11 as at 12*a* adjacent their bottom edges so that the cover may swing between an open and closed position.

Projecting inwardly toward the back plate 11 is a projection or latch plate 12*c* extending from the top of the cover 12 and which is intended to engage the top member 11*a* of the locking plate 11. In that regard, the particular form of engagements varies but it is, in some way, necessary to provide structure to secure the cover to the back plate by temporarily interconnecting the two.

Figure 5:
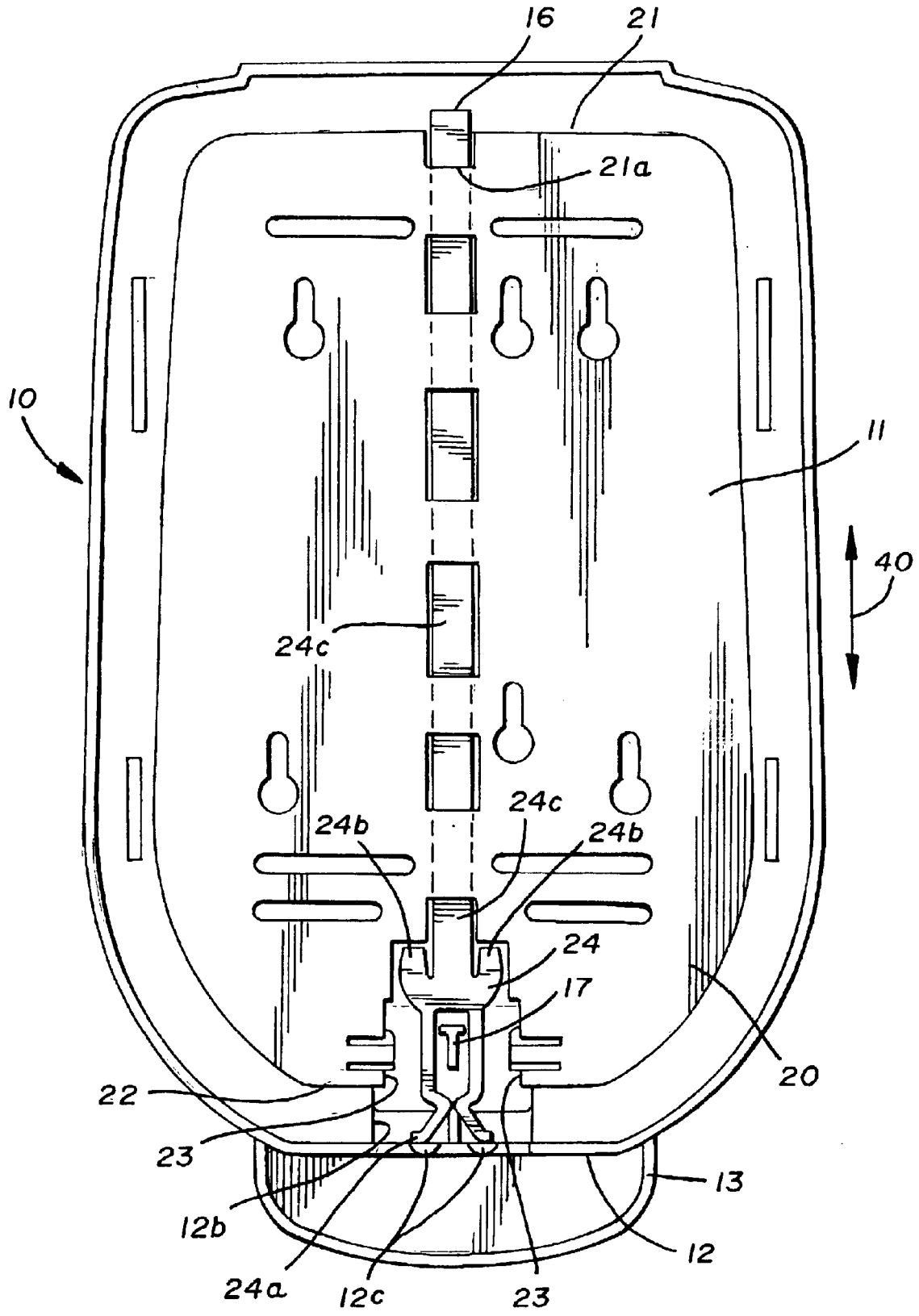
FIG. 5 is a sectional view taken along the line 5—5 of FIG. 4 showing the back plate in the locked position.
Figure 6:
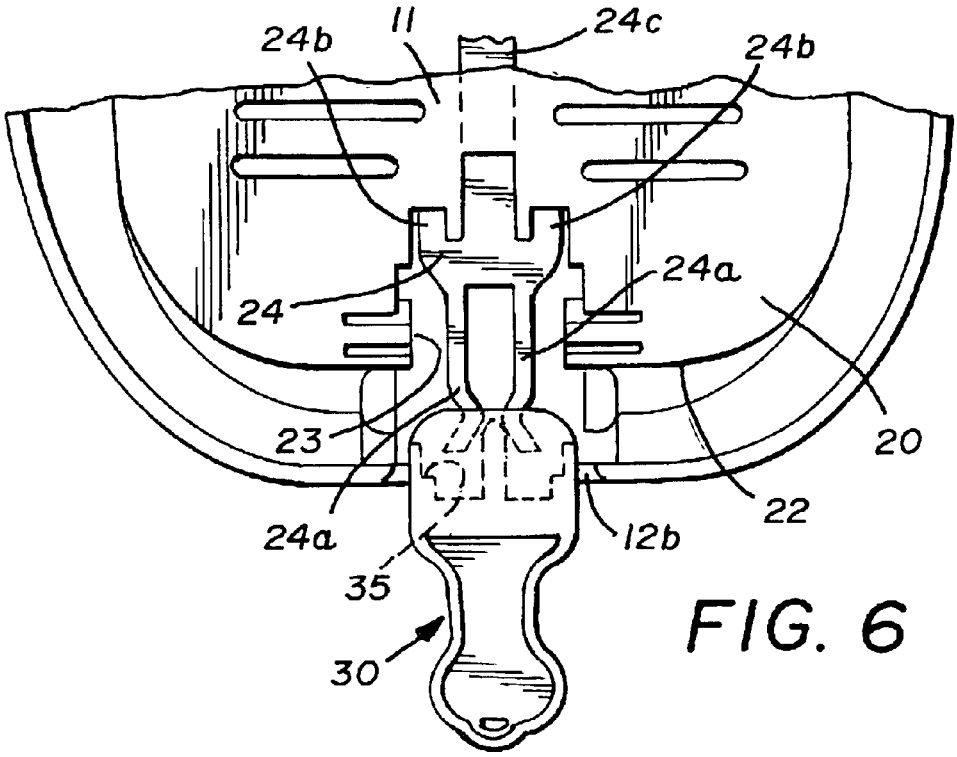
FIG. 6 is a partial sectional view showing the key partially inserted into the dispenser.
Figure 7:
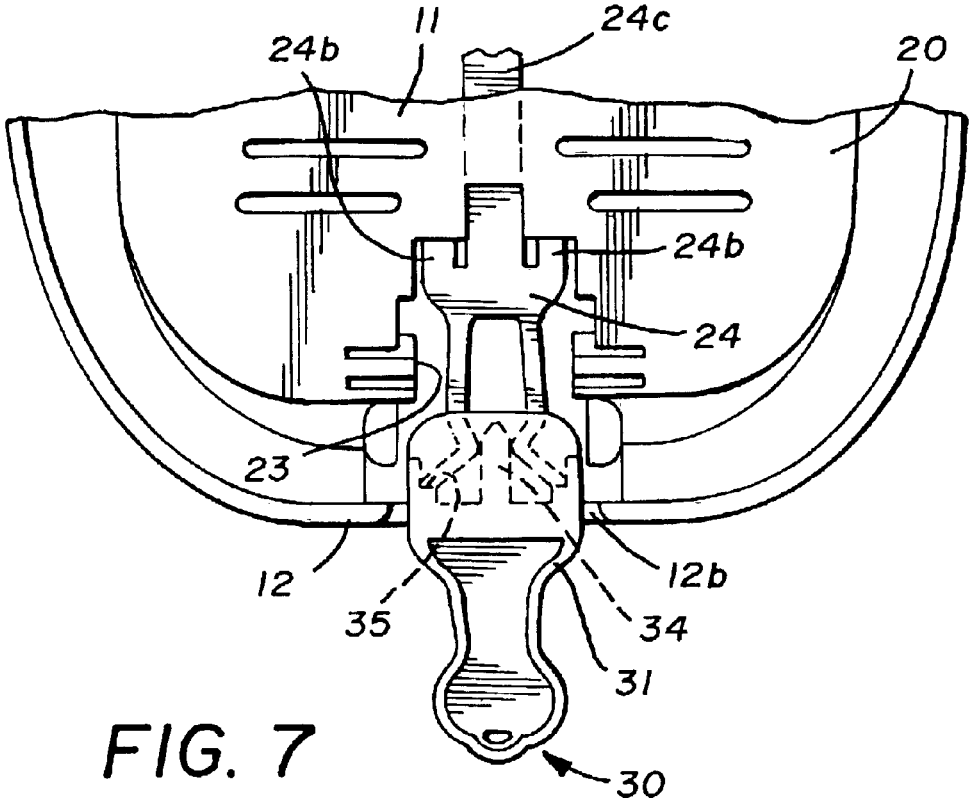
FIG. 7 is a partial sectional view showing the key fully engaged with the back plate for movement in an upward direction to unlock the dispenser.

Turning then to FIGS. 5, 6, and 7, it will be noted that the locking plate or bar 20 is carried by back plate 11 and includes a top edge 21 and a bottom edge 22. This locking plate or bar is slidably received on back plate 11 for movement in the direction of the arrow 40. Disposed on the top edge 21 is a recess 21*a* intended to engage the projection 16 of the cover when the dispenser is in a closed position so that when locking plate or bar is in its lower position the cover is engaged and the cover is locked in position. Movement of the locking bar 20 upwardly disengages it from the cover and unlocks the dispenser. In the prior art the lower end of locking plate or bar 20 is readily accessible from the bottom of the unit and can simply be pushed upwardly to unlock the dispenser.

Still referring to FIG. 5 of the drawings, it will be noted that a recess 23 is provided in the bottom edge 22 of locking plate or bar 20. This recess extends upwardly from the bottom edge 22 and is intended to receive an engagement bar 24 which is movable along the back plate as will be described. This engagement bar 24 has bifurcated depending legs 24*a*, 24*a* which are flared outwardly at their distal ends and opposed upwardly projecting arms 24*b*, 24*b* which are disposed on opposed sides of central stud or body 24*c*.

Figure 2:
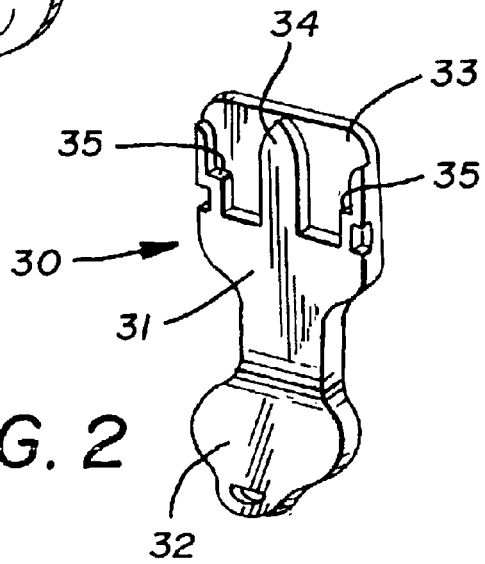
FIG. 2 is a perspective view of the key used to activate the back plate of the locking system.
Figure 3:
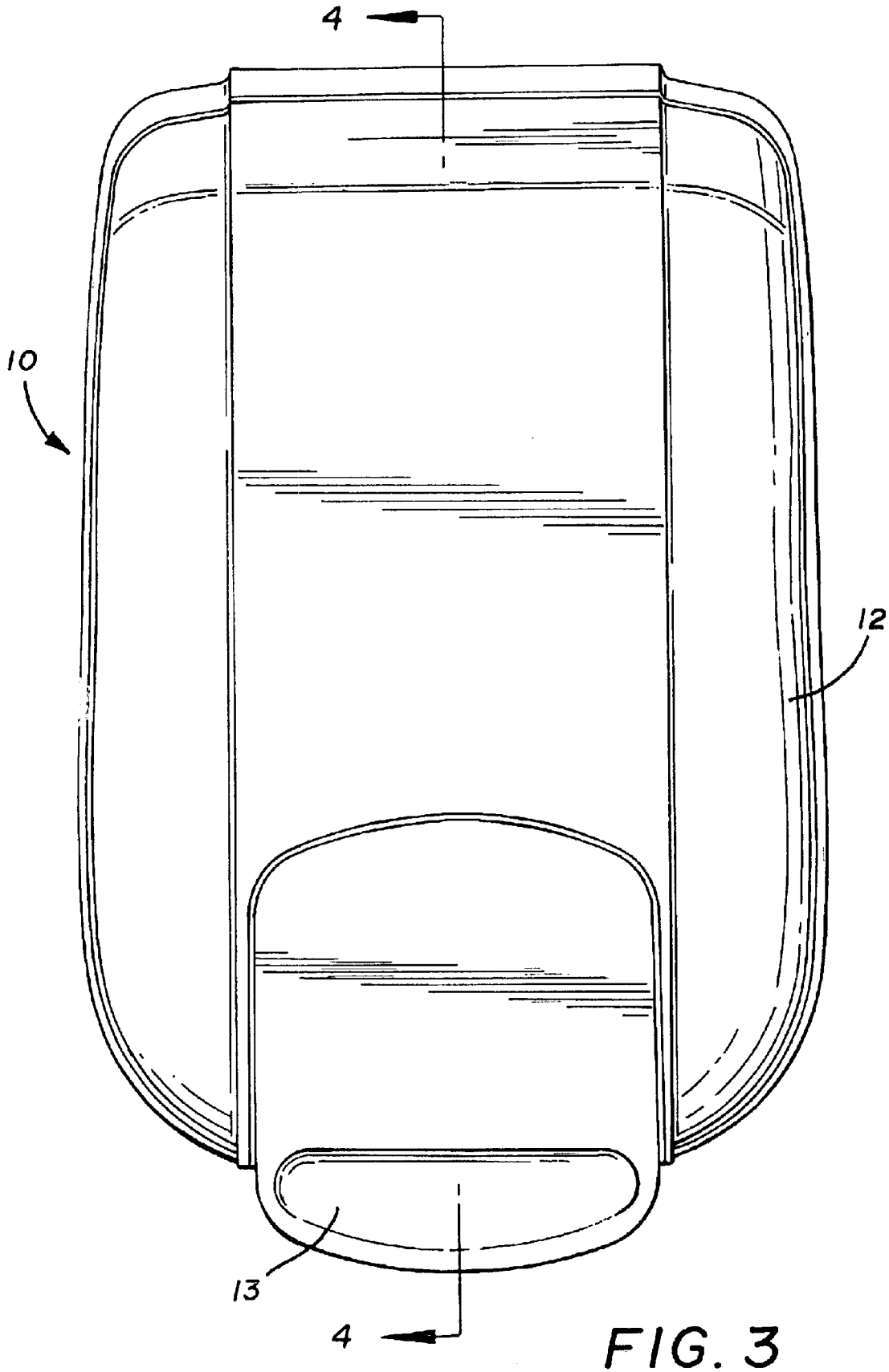
FIG. 3 is a front elevational view of the dispenser.

Referring to FIG. 2 of the drawings, for a description of the key 30, it will be noted that the key has a body 31 with a depending handle 32 which is angled outwardly from the plane of the body 31 for ease of use as will be described below. The body 31 terminates in an upwardly directed, pointed divider member 34. The key 30 also includes shelf or ledge means 35, 35 on opposite sides of divider member 34. It will be noted that the pointed offset divider 34 and the side edges containing the shelves or ledges 35, 35 are offset from the front face 33 of the key to form shoulders for engagement with the engagement bar.

Turning then to FIG. 5 of the drawings, again, it will be noted that, with the engagement bar 24 in place, the projecting ends of the legs 24*a*, 24*a* of engagement bar 24 rest on projections 12*c*, 12*c* on the bottom of the cover 12. In this fashion it will be readily noted that the engagement bar 24 and locking plate or bar 20 are inaccessible from the bottom on the container. In fact, they are not even visible.

Turning then to FIGS. 6 and 7 of the drawings, it will be noted that the key 30 is shown as being inserted into the apertures 12*b*, 12*b*. In that regard, the bottom of cover 12 has three apertures 12*b*, formed along its lower edge and separated by projections 12*c*, 12*c* from the remaining lower body portion of the cover 12 thereby forming therein openings for receipt of key 30.

It will also be that the pointed engagement bar 24, when inserted through the central aperture 12*b*, lies between the distal ends of the legs 24*a*, 24*a* of the engagement bar 24. As the key 30 is moved upwardly the legs 24*a*, 24*a*, being flexible, will separate as shown in FIG. 7 of the drawings. This makes it possible for the distal ends of the legs 24*a*, 24*a* to come into engagement with the ledges 35, 35 thereby making it possible to move bar 24 upwardly. Upon movement of the bar in this direction, central stud 24*c* will engage the locking plate or bar 20 thereby making it possible, upon further upward movement of the key 30, to move the plate 20 upward to disengage the member 16 from the back plate enabling the dispenser to be unlocked and permitting the cover 12 to be opened with respect to the back plate 11.

Referring to FIGS. 8–12 of the drawings, it will be seen that a modified form of the invention is presented.

It will be understood that the form of the invention illustrated and described in FIGS. 1–9 includes the provision of a separate key 30 which is intended to be retained in the possession of the individual responsible for maintenance of the dispenser 10. It is, however, certainly possible that such key could be misplaced or unavailable at any given moment and the modified form of the invention of FIGS. 8–12 is intended to anticipate that contingency.

Referring to FIGS. 8–12 it will be noted that the dispenser per se including the engagement bar 24 are identical in structure with that illustrated in FIGS. 1–9 of the drawings it will not be described in great detail herein.

In this form of the invention, however, a more or permanent key 130 is involved and remains in the dispenser at all time.

Figure 11:
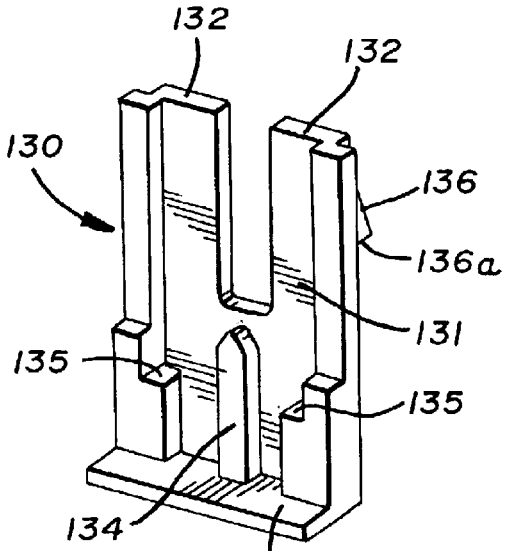
FIG. 11 is a perspective view showing the front of the key used in the modified form of the invention.
Figure 12:
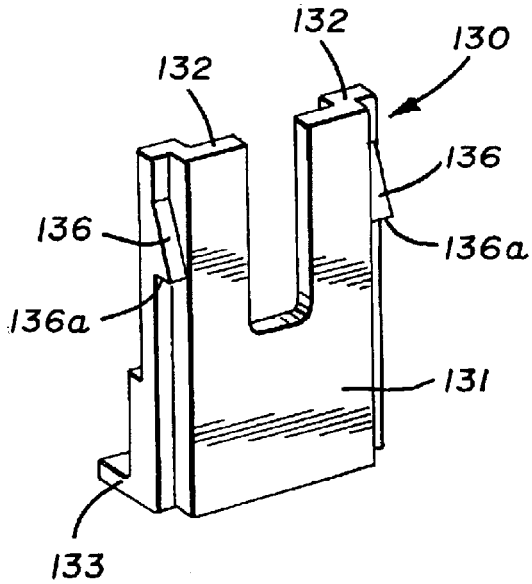
FIG. 12 is a perspective view showing the rear of the key used in the modified form of the invention.

In that regard, and referring to FIG. 11 of the drawings, this permanent key 130 has a structure similar to that of key 30 and includes a body 131 with bifurcated projecting legs 132, 132 and a base 133. Projecting upwardly from the base 133 is a pointed divider member 134. Still referring to FIGS. 11 and 12 of the drawings it will be seen that the rear surface of the permanent key 130 includes projecting ramps 136, 136 for purposes which will be described herein.

Figure 8:
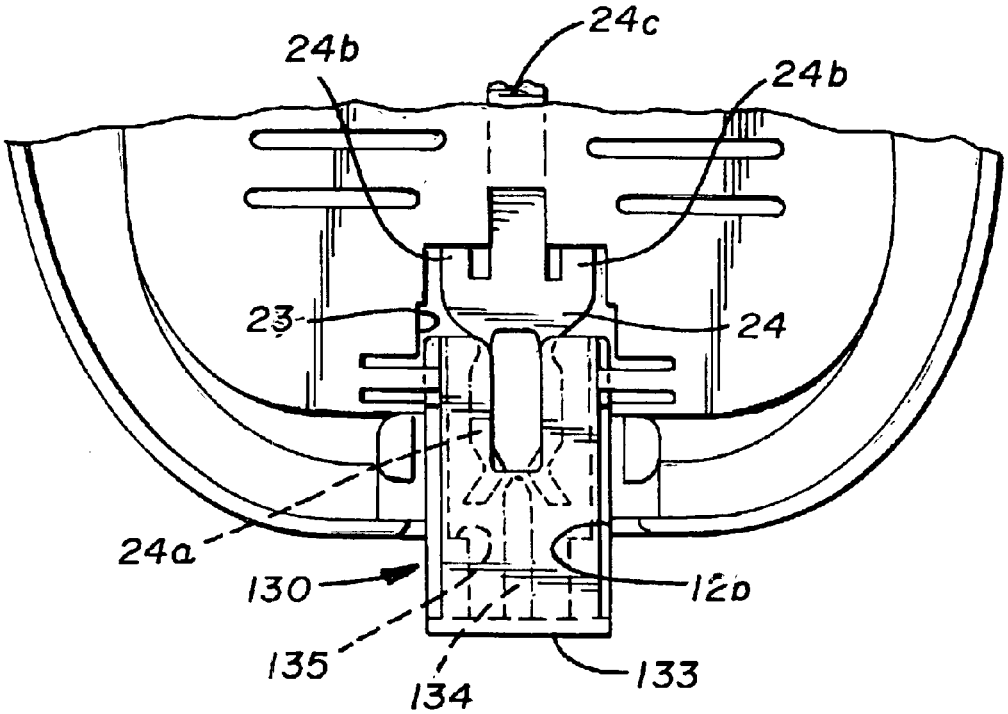
FIG. 8 is a partial sectional view showing a modified form of the invention in the locked position.
Figure 9:
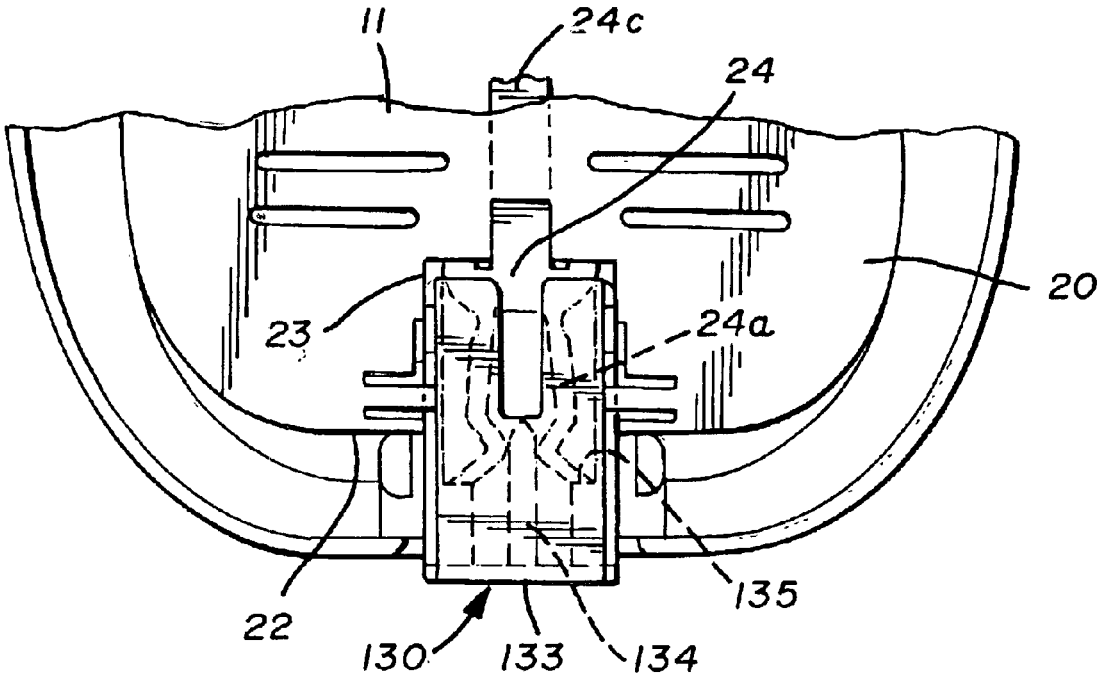
FIG. 9 is a view similar to FIG. 8 showing the modified form of the invention in the unlocked position.
Figure 10:
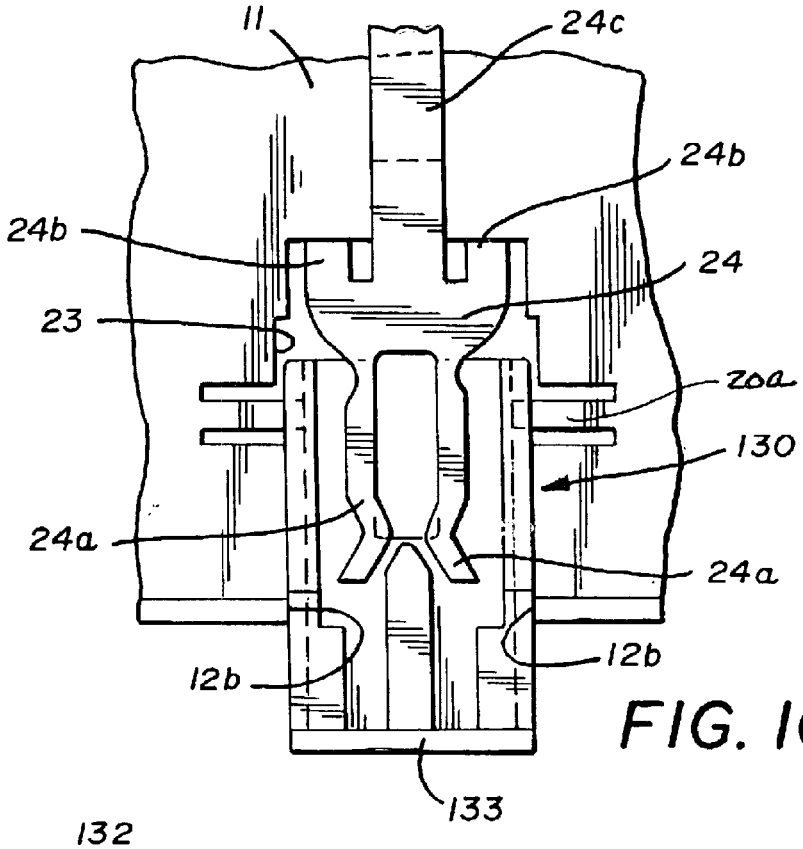
FIG. 10 is an enlarged view similar to FIG. 8.

The bifurcated legs 132, 132 are intended to be received through opposed apertures 12*b* in the bottom of the cover. Here again the pointed divider 134 is normally disposed just below the bifurcated legs 24*a*, 24*a* of the engagement bar. The permanent key 30 is inserted to the extent shown in FIG. 10 of the drawings at which point it is held in place against removal by the bottom edges 136*a*, 136*a* of the ramps 136, 136 engaging rib 20*a*. At this point divider member 134 is disposed below legs 24*a*, 24*a* of engagement bar 24. Moving the permanent key 130 upwardly, however, as can be seen in FIGS. 8 and 9 of the drawings will spread the bifurcated legs 24*a*, 24*a* of the engagement bar 24 until such time as the engagement bar is moved upwardly to engage the bottom of the locking plate or bar 20. Further movement in an upward direction will cause the locking plate or bar 20 to be moved upwardly to unlock the device. When the cover is closed, the force of the top of the cover will shove the locking plate or bar 20 downwardly to return the key to the FIG. 9 position without completely separating it from the dispenser combination.

While a full and complete description of the invention has been set forth in accordance with the dictates of the Patent Statutes, it should be understood that modifications can be resorted to without departing from the spirit hereof or the scope of the appended claims.

What is claimed is:

1. A locking system for a dispenser having a back plate and a cover, hingedly connected to the back plate, for movement between open and closed positions, and locking means, carried by the back plate and the cover for selectively locking and unlocking the cover to the back plate, comprising:

a) a latch plate, carried by the cover in opposed relationship to the point of hinged connection to the back plate;

b) an elongate locking bar, carried by the back plate, and having a first end movable into and out of engagement with said latch plate;

c) engagement means, carried by the balk plate and movable into and out of engagement with a second end of said locking bar; and d) a key, configured for engagement with said engagement means whereby engagement of said engagement means moves said engagement means into contact with said elongate locking bar and moves said locking bar out of engagement with said latch plate.

2. The locking system of claim 1 wherein said second end of said locking bar has a recessed area for receipt of said engagement means.

3. The locking system of claim 2 wherein said engagement means includes an elongate body portion and a pair of resilient, opposed legs projecting from a first end thereof and a projecting central stud projecting from a second end thereof.

4. The locking system of claim 3 wherein said key has a body portion with a centrally disposed, projecting divider member for receipt between said resilient, opposed legs of said engagement member when said key is engaged therewith.

5. The locking system of claim 4 wherein said key includes opposed shoulders disposed on opposed sides of said divider member.

6. The locking system of claim 5 wherein the cover has a plurality of apertures in its hinged end; the distal ends of said resilient, opposed legs of said engagement member being disposed between said apertures.

7. The locking system of claim 6 wherein said shoulders are engagable with the distal ends of said resilient, opposed legs of said engagement means when said divider member is in engagement with said opposed legs thereof.

8. The locking system of claim 1 wherein said key includes a handle.

9. The locking system of claim 8 wherein said handle includes a through aperture.

10. The locking system of claim 1 wherein said key includes at least one first projection for selective engagement with said engagement means.

11. The locking system of claim 3 wherein said key includes at least one second projection for selective engagement between said opposed legs of said engagement member.

* * * * *